US010174489B2

(12) United States Patent
Ishimaru et al.

(10) Patent No.: US 10,174,489 B2
(45) Date of Patent: Jan. 8, 2019

(54) FLUSH TOILET APPARATUS

(71) Applicant: TOTO LTD., Kitakyushu-shi, Fukuoka (JP)

(72) Inventors: Ryoko Ishimaru, Kitakyushu (JP); Tatsunari Harashima, Kitakyushu (JP); Hidekazu Kitaura, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/280,547

(22) Filed: Sep. 29, 2016

(65) Prior Publication Data

US 2017/0089052 A1 Mar. 30, 2017

(30) Foreign Application Priority Data

Sep. 30, 2015 (JP) ..... 2015-194112

(51) Int. Cl.

| | |
|---|---|
| ***E03D 1/08*** | (2006.01) |
| ***E03D 1/32*** | (2006.01) |
| ***E03D 5/01*** | (2006.01) |
| ***E03D 11/08*** | (2006.01) |

(52) U.S. Cl.

CPC ..... *E03D 1/087* (2013.01); *E03D 1/32* (2013.01); *E03D 5/01* (2013.01); *E03D 11/08* (2013.01)

(58) Field of Classification Search

CPC ..... E03D 1/087
USPC ..... 4/353
See application file for complete search history.

(56) References Cited

U.S. PATENT DOCUMENTS 4,077,602 A * 3/1978 Klessig ..... F16K 31/124 251/25
2014/0109307 A1* 4/2014 Kitaura ..... E03D 1/085 4/329

FOREIGN PATENT DOCUMENTS

| | | | |
|---|---|---|---|
| CN | 1693604 | A | 11/2005 |
| JP | 2015-086687 | A | 5/2015 |
| WO | 2005106141 | A1 | 11/2005 |

* cited by examiner

*Primary Examiner* — Christine Skubinna
(74) *Attorney, Agent, or Firm* — Baker & Hostetler LLP

(57) ABSTRACT

A flush toilet apparatus for discharging waste by a jet pump action is disclosed. The flush toilet apparatus has an overflow portion configured to overflow a portion of flush water flowing from a throat pipe into a water conduit into a reservoir tank so that when the flow rate of water flowing inside the throat pipe exceeds a predetermined specified flow rate, the flow rate of water supplied from the water conduit to a bowl portion is reduced to less than a predetermined specified flow rate.

4 Claims, 8 Drawing Sheets

FLUSH TOILET APPARATUS

BACKGROUND OF THE INVENTION

Field of the Invention

The present invention relates to a flush toilet apparatus, and in particular to a flush toilet apparatus for discharging waste with flush water supplied by a jet pump action.

Related Art

Conventionally, as described for example in JP2015-86687A, there are known flush toilet apparatuses comprising a pump unit capable of continuously supplying high force water to a toilet bowl surface.

The toilet spouts flush water from a jet nozzle directly connected to a utility water pipe; the spouting causes water in a reservoir tank to be suctioned into a throat pipe, so that a large flow rate of flush water is supplied to the toilet. In such jet pump units, a constant flow rate valve is installed on the upstream side of the jet nozzle, and the flow rate of water supplied to the jet nozzle is a predetermined rate.

A problem arises, however, in that the flow rate of water supplied to the jet nozzle varies as it passes through the constant flow rate valve, due to conditions such as the utility water pressure at the site, etc. With a jet pump unit, when there is variability in the flow rate supplied to the jet nozzle, flush water in the reservoir tank is suctioned out and supplied to the toilet using flush water discharged from the jet nozzle, therefore variability in the volume of water discharged from the jet nozzle increases even more. Therefore the amount of flush water supplied to the toilet also varies greatly.

As a result, when the flow rate of water supplied from a constant flow rate valve to a jet nozzle increases due to that variability, the flush water volume supplied to the toilet also increases, leading to the problem that water overflows from the bowl surface.

To address the problem, a solution has been conceived whereby a setting is used so that the flow rate of water supplied to the jet nozzle is reduced from the beginning, preventing overflow from the bowl surface when the flow rate of water supplied by the constant flow rate valve to the jet nozzle increases due to that variability. In that case, however, if the flow rate of water supplied from a constant flow rate valve to a jet nozzle is reduced due to that variability, the amount of water supplied to the toilet will decrease even further.

The leads to the problem of reduced flushing performance and poor toilet flushing.

SUMMARY OF THE INVENTION

It is therefore an object of the present invention to provide a flush toilet apparatus capable of limiting the reduction in flushing performance, while preventing splashing or overflow of flush water to outside the bowl portion.

The above object is achieved according to the present invention by providing a flush toilet apparatus for discharging waste with flush water supplied by a jet pump action, comprising: a toilet main body having a bowl portion and a water conduit for conducting the flush water to the bowl portion; a reservoir tank configured to hold the flush water supplied to the water conduit; a jet pump unit disposed inside the reservoir tank; and a valve apparatus configured to supply the flush water with a predetermined flow rate to the jet pump unit; wherein the jet pump unit comprises: a throat pipe having a suction port, submerged in the flush water and formed on an upstream side thereof so as to suction the flush water in the reservoir tank, and a downstream end for allowing the flush water therein to flow out; and a jet nozzle configured to jet the flush water into the throat pipe and suction the flush water in the reservoir tank into the throat pipe through the suction port of the throat pipe by the jet pump action so that the flow rate of the flush water in the throat pipe is increased more than the flow rate of the flush water jetted from the jet nozzle; wherein the flush toilet apparatus further comprises: an overflow portion configured to overflow a portion of the flush water, which is supplied from the throat pipe to the water conduit, into the reservoir tank so that when the flow rate of the flush water in the throat pipe exceeds a predetermined specified flow rate, the flow rate of the flush water supplied from the water conduit to the bowl portion is reduced to less than the predetermined specified flow rate.

In the present invention thus constituted, when the flow rate of water inside the throat pipe exceeds a predetermined specified flow rate (at which flush water does not splash outside the bowl portion), a portion of the flush water supplied from the throat pipe can be caused to overflow inside the reservoir tank. Thus even if variability in the flow rate of flush water supplied to the jet nozzle from a valve apparatus (e.g., a constant flow rate valve) occurs due to variability in conditions such as utility water pressure at the site, splashing or overflow of flush water to outside the bowl portion can be prevented by reducing the flow rate of water supplied from a water conduit to the bowl portion.

In addition, in the present invention, flush water is jetted from a jet nozzle into the throat pipe, and flush water can be suctioned into the throat pipe from a suction port on the throat pipe by a jet pump action, thereby increasing the flow rate of flush water in the throat pipe more than the flow rate of water jetted from the jet nozzle. Therefore when the flow rate of water supplied from the valve apparatus to the jet nozzle declines due to variability, the flow rate of water supplied from the valve apparatus to the jet nozzle can be set to a relatively large flow rate approaching a predetermined specified flow rate, thus constraining the decline in flushing performance.

As the result, according to the present invention, splashing or overflow of flush water outside the bowl portion can be prevented, and a decline in flushing performance can be constrained.

In a preferred embodiment of the present invention, the overflow portion comprises a flow path opening portion formed at a height position at or above a full water level of the reservoir tank.

In the present invention thus constituted, an overflow portion comprises a flow path opening portion formed at a height position at or above the full water level of the reservoir. Therefore, if the flow path opening portion is hypothetically formed at a position lower than the full water level of the reservoir tank, then either flush water flowing in the throat pipe becomes unable to flow out into the reservoir tank, or the outflow amount is insufficient. This raises the risk that the flow rate of water supplied to the bowl portion cannot be reduced, so that the flush water splashes outside the bowl portion. This type of risk can be prevented by the present invention. In addition, a decline in flushing performance can be constrained even when the flow rate of flush water supplied from a valve apparatus to a jet nozzle declines.

In another preferred embodiment of the present invention, the overflow portion is configured not to allow the flush water supplied from the throat pipe to the water conduit to overflow from the flow path opening portion into the reservoir tank, when the flow rate of the flush water inside the throat pipe does not exceed the predetermined specified flow rate.

In the present invention thus constituted, if the flow rate of water in the throat pipe does not exceed a predetermined specified flow rate, the flush water is not caused to overflow into the reservoir tank, and when the flow rate of water supplied to the jet nozzle is small due to variability, the flush water is not caused to overflow into the tank, but rather is supplied to the water conduit. As a result, the decline in flushing performance caused by variability in the flow rate of water supplied from a valve apparatus to a jet nozzle can be more reliably constrained.

In still another preferred embodiment of the present invention, the flow path opening of the overflow portion is formed at a height position close to the full water level of the reservoir tank.

In the present invention thus constituted, the flow path opening is formed at a height position close to the full water level of the reservoir tank. Therefore, when the flow rate of water supplied from the valve apparatus to the jet nozzle varies and increases, and the flow rate of water inside the throat pipe exceeds a predetermined specified flow rate such that the flow path on the downstream side of the overflow portion becomes full, the flow rate of water supplied to the bowl portion can be reduced to less than a predetermined specified flow rate. I.e., compared to the case when a flow path opening portion is formed on the top side of the throat pipe, overflowing of flush water from the bowl portion can be more reliably prevented, at an earlier stage.

In another preferred embodiment of the present invention, the flush toilet apparatus further comprises a discharge port formed between the throat pipe and the water conduit, and disposed at a height position close to the full water level of the reservoir tank, wherein the flow path opening portion of the overflow portion is formed between the throat pipe and the discharge port.

In the present invention thus constituted, the flow path opening portion of the overflow portion is formed between the throat pipe and the discharge port. Therefore, when the flow rate of water supplied from the valve apparatus to the jet nozzle increases due to variability, and the flow rate of water inside the throat pipe exceeds a predetermined specified flow rate such that the flow path on the downstream side of the drain port portion becomes full, the flow rate of water supplied to the bowl portion can be reduced to less than the predetermined specified flow rate. I.e., compared to the case when a flow path opening portion is formed on the top side of the throat pipe, overflowing of flush water from the bowl portion can be more reliably prevented, at an earlier stage.

In still another preferred embodiment of the present invention, the downstream end of the throat pipe is disposed apart from and above the discharge port, and the flow path opening portion of the overflow portion is formed between the discharge port and the downstream end of the throat pipe.

In the present invention thus constituted, the downstream end of the throat pipe is disposed apart from and above the discharge port, and the flow path opening portion of the overflow portion is formed between the discharge port and the downstream end of throat pipe. Therefore, when the flow rate of water supplied from the valve apparatus to the jet nozzle increases due to variability, and the flow rate of water inside the throat pipe exceeds a predetermined specified flow rate such that the flow path on the downstream side of the drain port portion becomes full, the flow rate of water supplied to the bowl portion can be more reliably reduced to less than a predetermined specified flow rate. I.e., compared to the case when a flow path opening portion is formed on the top side of the throat pipe, overflowing of flush water from the bowl portion can be more reliably prevented at an earlier stage.

In the present invention, preferably, an upstream-side flow path is formed on an upstream side of the flow path opening portion of the overflow portion, and the upstream-side flow path is formed to communicate with the discharge port.

In the present invention thus constituted, an upstream-side flow path is formed on the upstream side of the flow path opening portion, and the upstream-side flow path is formed to communicate with the discharge port. Therefore when the flow rate of water supplied from the valve apparatus to the jet nozzle varies and increases, and the flow rate of water inside the throat pipe exceeds a predetermined specified flow rate such that the flow path on the downstream side of the discharge port becomes full, the flow rate of water supplied to the bowl portion can be more reliably reduced to less than a predetermined specified flow rate. I.e., compared to the case when a flow path opening portion of the overflow portion is formed on the top side of the throat pipe, overflowing of flush water from the bowl portion can be even more reliably prevented at an earlier stage.

In the present invention, preferably, at least a portion of the flow path opening portion of the overflow portion is formed on the throat pipe.

In the present invention thus constituted, at least a portion of the flow path opening portion of the overflow portion is formed on the throat pipe, and therefore the flow path opening portion can be formed in a relatively simple manner using a throat pipe.

Effect of the Invention

In accordance with the flush toilet apparatus of the present invention, declines in flushing performance can be constrained while preventing splashing or overflowing of flush water to outside the bowl portion.

DESCRIPTION OF THE PREFERRED EMBODIMENTS

Below, referring to the attached drawings, a flush toilet apparatus according to a first embodiment of the present invention is explained.

Figure 1:
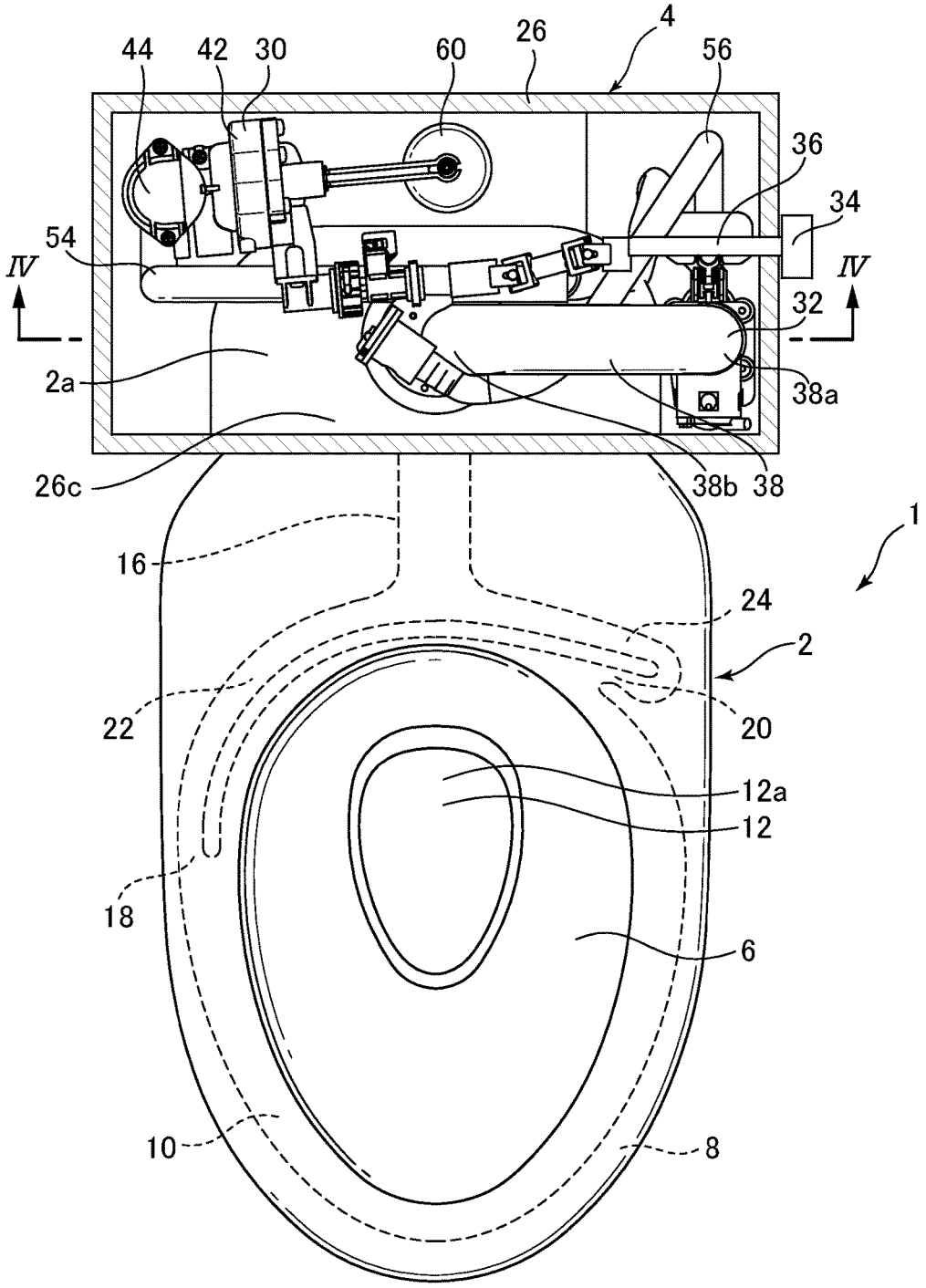
FIG. 1 is a plan view showing a flush toilet apparatus according to a first embodiment of the present invention.
Figure 2:
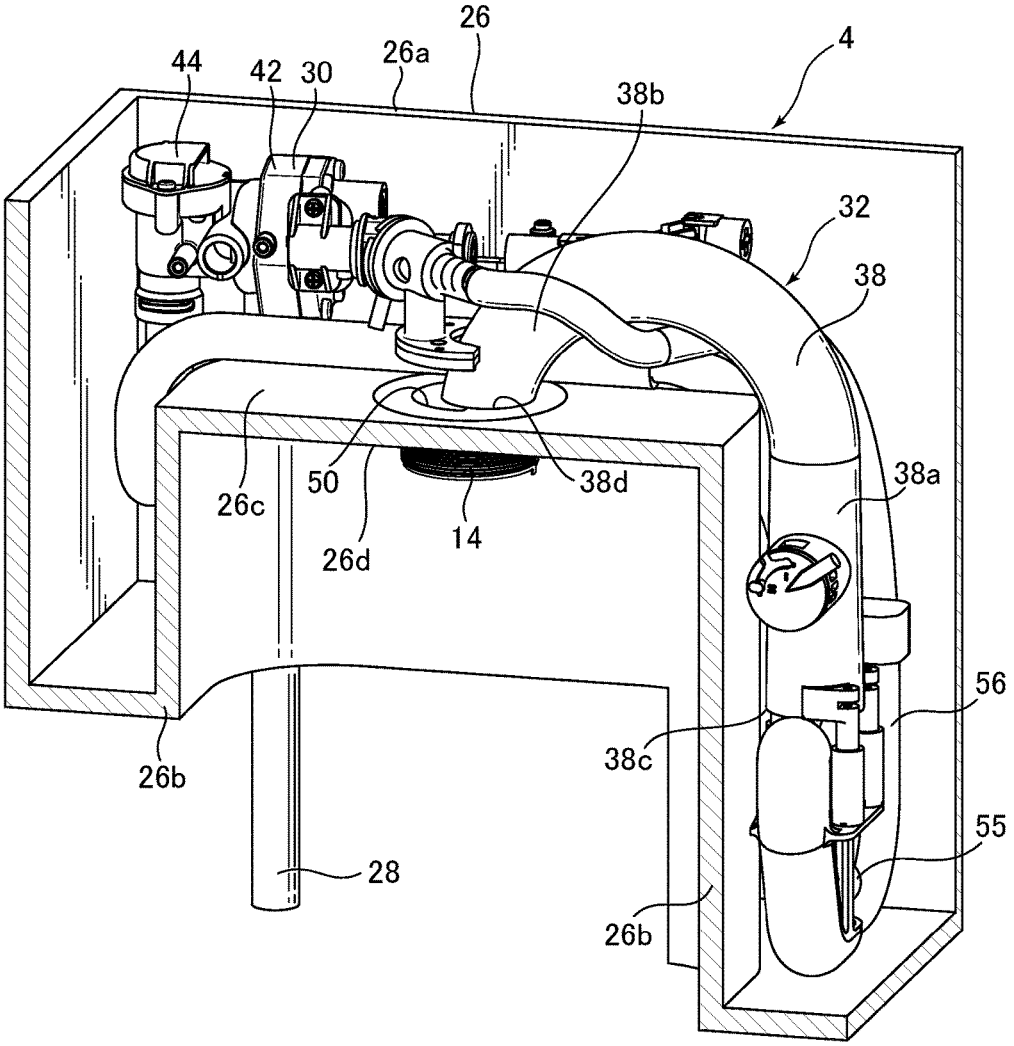
FIG. 2 is a partial cross section perspective view showing the internal structure of a flush water tank apparatus in a flush toilet apparatus according to a first embodiment of the present invention.

First, using FIGS. 1 and 2, the basic structure of a flush toilet apparatus according to a first embodiment of the present invention is explained.

First, as shown in FIGS. 1 and 2, a flush toilet apparatus 1 according to an embodiment of the present invention comprises a toilet main body 2 and a flush water tank apparatus 4 for supplying flush water to the toilet main body 2. The flush toilet apparatus 1 is a water conserving wash-down type of flush toilet which flushes using, for example, 3.8 liters to 6 liters of flush water, and more preferably using 3.8 liters to 4.8 liters of flush water.

Note that it is explained the flush toilet apparatus of the present embodiment below using a form in which it is applied to a wash-down type of toilet utilizing water head, but the present invention is not limited to such forms, and may also be applied to flush toilets of other types, including siphon-type toilets and the like, in which a siphon action is utilized to suction waste in the bowl portion and discharge it to the outside all at once from the discharge trap pipe.

The toilet main body 2 comprises a bowl portion 6 disposed on the front side thereof, a rim portion 8 formed on the upper edge of the bowl portion 6, and a shelf portion 10 formed on the inside circumference of the rim portion 8.

Also, a trap discharge path 12 inlet 12*a* is opened on the bottom portion of the bowl portion 6 of the toilet main body. The trap discharge path 12 comprises an upward-extending ascending pipe (not shown) and a downward-extending descending pipe (not shown).

The toilet main body 2 comprises a water conduit 16 into which flush water discharged from the flush water tank apparatus 4 discharge port 14 (see FIG. 2) flows, a first rim spout port 18 formed on the left side center, and a second rim spout port 20 formed on the right side rear, as seen from the front of the toilet main body 2.

Also, the water conduit 16 is branched into a first water conduit 22 and a second water conduit 24 on the downstream side thereof, and the downstream-side flow paths (flow path cross sectional areas) thereof are narrow compared to the upstream side. Flush water in the water conduit 16 passes through a first water conduit 22 to reach a first rim spout port 18, while also passing through a second water conduit 24 to reach a second rim spout port 20. Such flush water is respectively spouted from a first rim spout port 18 and a second rim spout port 20, and flushes the bowl portion 6 to discharge waste from the trap discharge path 12.

Next, using FIGS. 1 through 7, the constitution of the flush water tank apparatus 4 is explained.

First, as shown in FIGS. 1 through 4, the flush water tank apparatus 4 comprises: a reservoir tank 26 for storing flush water supplied to the water conduit 16, a water supply pipe line 28 for supplying flush water to the reservoir tank 26, a jet pump unit 32, disposed at the downstream end of the water supply pipe line 28, for supplying flush water to the toilet main body 2, and a manual lever 34 for supplying flush water by user manual operation.

The reservoir tank 26 is a reservoir tank of the low silhouette type, positioned at a relatively low position on the rear side of the toilet main body 2. The majority of a low silhouette type of reservoir tank of the type is disposed below the top surface of the toilet main body 2. For example, more than half its length in the reservoir tank 26 height direction is disposed below the top surface of the toilet main body 2. Also, because the reservoir tank 26 is disposed down to the lower portion of the toilet main body 2, the peak portion 26*a* of the reservoir tank 26 can be positioned at a relatively low position. Hence the reservoir tank 26 on the rear side of the flush toilet apparatus 1 is not prominent, and the aesthetic appearance and sense of luxury of the flush toilet apparatus 1 as a whole can be improved.

As evident from FIGS. 1 and 2, the reverse surface of the tank inside shelf surface 26*c*, i.e., the tank attaching surface 26*d*, which is the bottom surface of the tank, is attached to the rear portion 2*a* of the toilet main body 2. The discharge port 14 and the water conduit 16 of the toilet main body 2 are connected with the tank attaching surface 26*d* mounted on top of the rear portion 2*a* of toilet main body 2.

The reservoir tank 26 is a flat tank, with a front-to-back length which is shorter than its left-to-right width. As may be understood from FIGS. 1 and 2, square lower tank projecting portions 26*b*, projecting and extending under the toilet main body 2, are formed on the left and right side parts of the reservoir tank 26. With such a tank shape, the reservoir tank 26 is relatively small, while maintaining or improving water conservation and/or design characteristics as a whole.

A water shutoff (not shown) is disposed at the upstream end of a water supply pipe line 28 to shut off flush water supplied from a water supply source (not shown) such as an external utility pipe or the like. The water shutoff is provided to shut off water during installation of the flush toilet apparatus 1 or the like, and is held in an open state during normal use.

Figure 4:
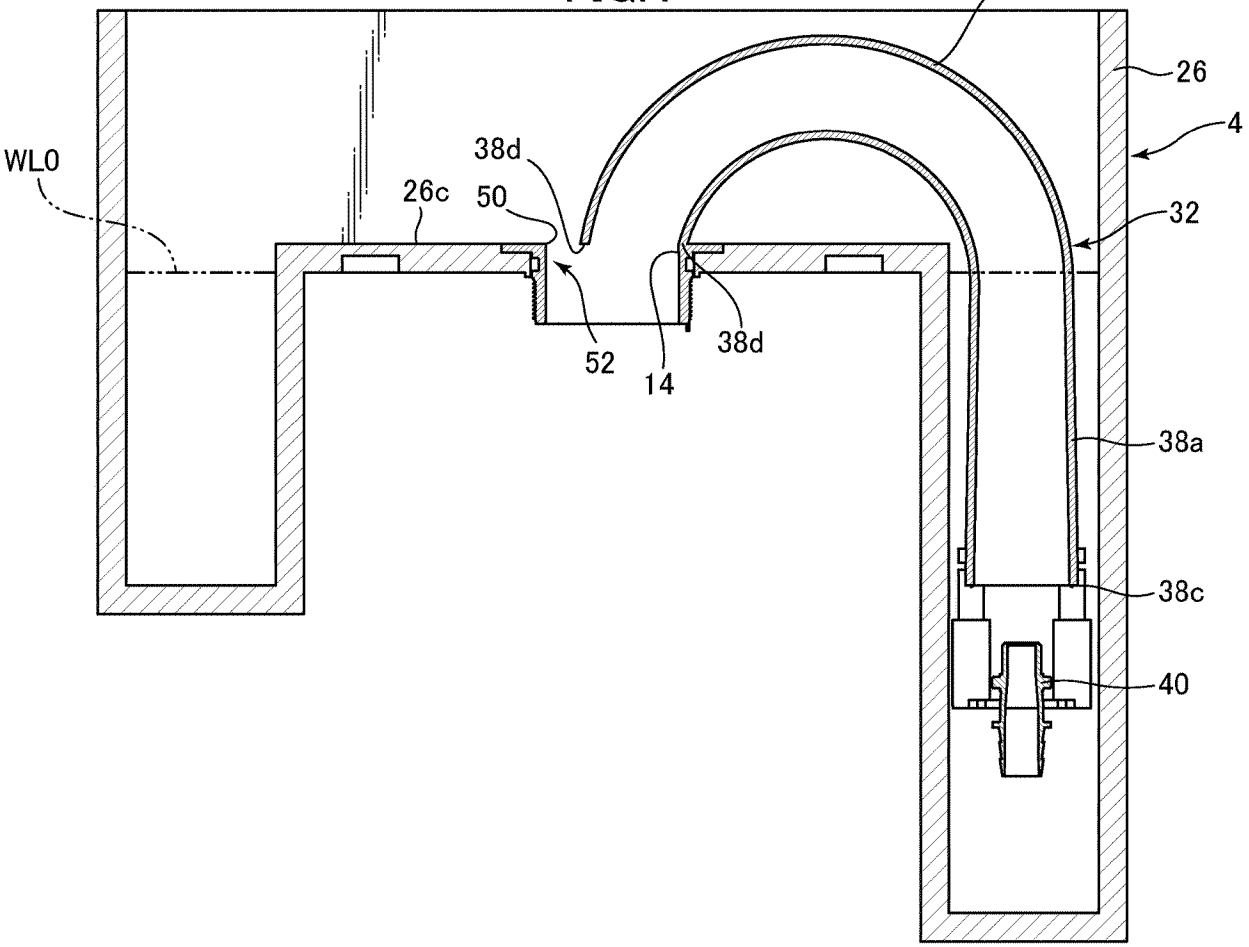
FIG. 4 is a cross section viewed along line IV-IV in FIG. 1.

As shown in FIGS. 2 and 4, a jet pump unit 32 is disposed inside the reservoir tank 26 with at least a portion thereof submerged in the reserved water inside the reservoir tank 26. The jet pump unit 32 comprises a throat pipe 38. The throat pipe 38 comprises an ascending pipe portion 38*a* extending upward from below, and a descending pipe portion 38*b* extending from the vicinity of the top end of the ascending pipe portion 38*a* downward; as a whole it is formed in a reverse U shape (in other examples it has a reverse J shape or a gooseneck shape).

The jet pump unit 32 comprises: a jet nozzle 40, a water supply valve apparatus 30 connected to the water supply pipe line 28 for turning on/off the supply of flush water to the jet nozzle 40, a jet flow path 55 linked to the water supply valve apparatus 30 and jet nozzle 40, a makeup water flow path 56, being the flow path supplying flush water to the discharge port 14, and a switching means (not shown) for switching the supply of flush water jet from the jet nozzle 40 from the throat pipe 38 to the makeup water flow path 56 and reservoir tank 26.

By the switching means, flush water does not pass through the throat pipe 38 but rather is supplied to the makeup water flow path 56 when switched from the throat pipe 38 to the makeup water flow path 56.

Figure 6:
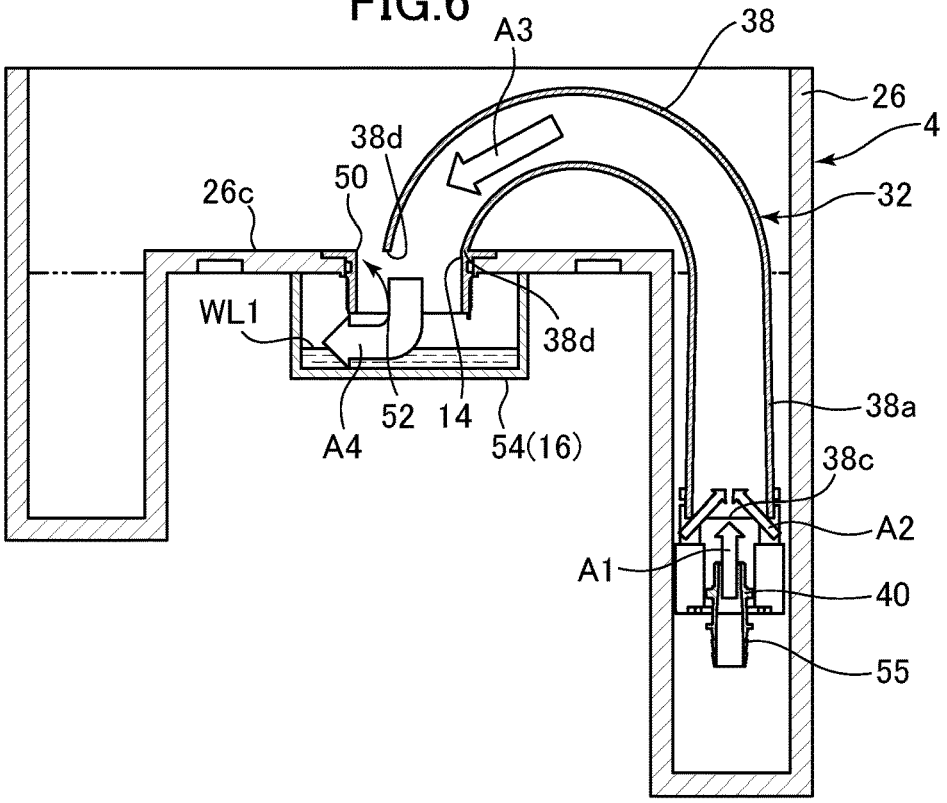
FIG. 6 is a diagram showing the appearance of flush water flowing in a throat pipe and an opening upstream-side flow path when the flow rate of water in the throat pipe does not fill up to a predetermined flow rate F1.

In addition, the jet pump unit 32 comprises a float 60 which moves up or down according to level of flush water held in the reservoir tank 26, and a linking means (not shown) for linking the float 60 to a switching means (not shown). As shown in FIGS. 4 and 6, an inlet portion into which flush water flows is formed between the suction port 38*c* of the throat pipe 38 and the jet nozzle 40.

The suction port 38*c* is formed at the upstream end of the ascending pipe portion 38*a* of the throat pipe 38; the suction port 38*c* is positioned inside the lower tank projecting portions 26*b* inside the reservoir tank 26. The downstream end 38*d* of the descending pipe portion 38*b* of throat pipe 38 is connected to the discharge port (discharge port portion) 14.

Also, the jet nozzle 40 is disposed to oppose the throat pipe 38 suction port 38*c*, and the suction port 38*c* and jet nozzle 40 are at all times submerged inside the reservoir tank 26.

Here, when high velocity flush water is jet toward the suction port 38*c* of the throat pipe 38, the space close to the suction port 38*c* facing the jet nozzle 40 is under negative pressure, and a jet pump action (ejector effect) is induced by the negative pressure. The distance between the jet nozzle 40 and the suction port 38*c* is set to a predetermined distance at which the above-described negative pressure is produced. The jet pump action causes flush water close to the suction port 38*c* to be suctioned so that the volume of the suctioned flush water is matched to the volume of flush water jetted from the jet nozzle 40. Therefore the flow rate of flush water in the throat pipe 38 is increased more than the flow rate of flush water jetted from the jet nozzle 40, and flush water is supplied to the water conduit 16 of the toilet main body 2.

The term "jet pump action" is explained.

Jet pump action means the action by which the flow itself of flush water under force being jet from the jet nozzle 40 toward the suction port 38*c* of the throat pipe 38 forms a negative pressure which directly pulls in flush water around the vicinity of that suction port 38*c*, without reliance on mechanical elements such as a pump, and the negative pressure is utilized to pressure feed flush water suctioned into the throat pipe 38 to the toilet main body 2 side.

Figure 3:
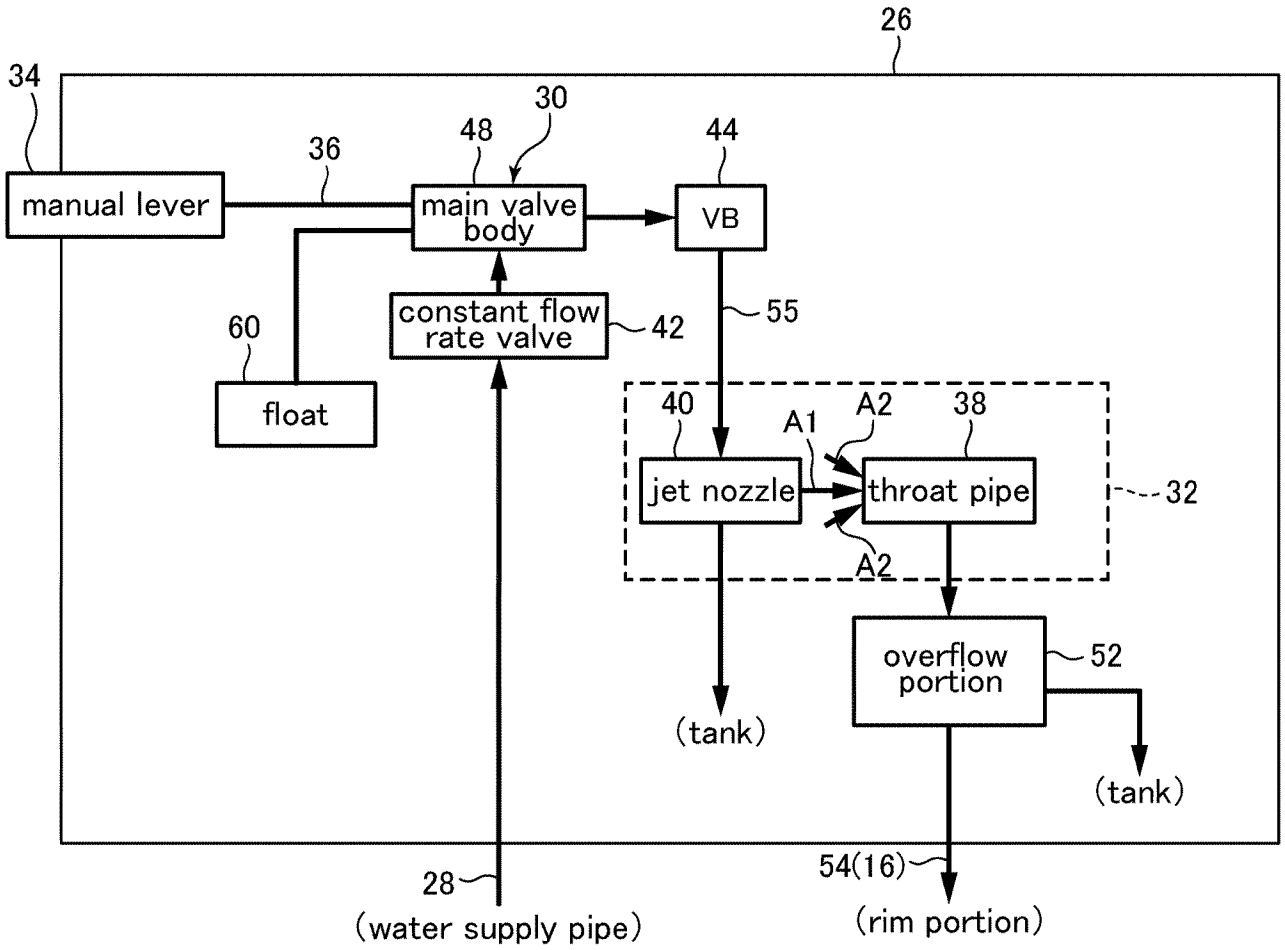
FIG. 3 is a block diagram showing the internal configuration of a flush water tank apparatus in a flush toilet apparatus according to a first embodiment of the present invention.

As shown in FIG. 3, a constant flow valve 42 is disposed on the water supply pipe line 28, on the upstream side of the water supply valve apparatus 30.

At the same time, a vacuum breaking valve 44 is placed on the jet flow path 55, on the downstream side of the water supply valve apparatus 30. The purpose of the vacuum breaking valve 44 is to take air from the outside and assure that the interior of the jet flow path 55 from the vacuum breaking valve 44 to the jet nozzle 40 does not go to a negative pressure.

The purpose of the constant flow rate valve 42 is to adjust flush water supplied to the water supply valve apparatus 30 to a predetermined essentially constant flow rate and supply a predetermined flow rate to the jet pump unit 32.

Here, when conditions such as utility water pressure and supply pressure, etc. vary at sites with a variety of usage environments (construction sites where the flush toilet apparatus 1 is being installed), it can occur that the flow rate (instantaneous flow rate) of water passing through the constant flow rate valve 42 also varies between each site. In such cases, therefore, variability also occurs in the flow rate of water jetted from the jet nozzle 40 and, accompanying this, variability occurs in the increased flow rate of water flowing inside the throat pipe 38.

Note that instead of the constant flow rate valve 42 of the present embodiment, it is also possible to adjust water passing through to a pre-determined essentially fixed flow rate using another valve apparatus such as a pressure reducing valve or the like.

In the constant flow rate valve 42 or other valve apparatus, as described above, when variability in the flow rate of water passing through the valves occurs, the variability in water flow rate can be suppressed by providing the overflow portion described below in the present embodiment.

Next, as shown in FIG. 3, water is supplied to the water supply valve apparatus 30 from the water supply pipe line 28 connected to the upstream side thereof. In addition, when the water supply valve apparatus 30 main valve body 48 opens, a constant flow rate of flush water is continuously supplied to the jet flow path 55 connected on the downstream side thereof, and is jet-spouted (entering the spouting state).

The main valve body 48 is a pilot-type diaphragm valve, wherein the main valve body 48 is opened and closed by the operation of the pilot valve (not shown). The pilot valve operates under manual operation by a user of a manual lever 34 connected to a drive shaft 36 to open and close the main valve body 48. The main valve body 48 is switched between a shutoff state (closed state), whereby in response to a closing operation of the pilot valve, the main valve body 48 seats on a main valve seat and water is shut off, and a water supply state (open state) whereby in response to a pilot valve opening operation, the main valve body 48 parts from the main valve seat and water is supplied. The pilot valve is connected to a float disposed inside the reservoir tank 26 and performs an opening and closing action in response to rising and falling of the float, so that the main valve body 48 is also opened and closed by the opening and closing operation.

The above-described makeup water flow path 56 is arranged so that the intake portion thereof is disposed to face the area between the throat pipe 38 suction port 38*c* and the jet nozzle 40, while above the flow path opening portion of the discharge port 14 the outlet portion thereof is disposed to open downward (toward the flow path opening portion).

Next, referring to FIGS. 2, 4, and 6, an overflow portion is explained. The flush toilet apparatus 1 comprises an overflow portion 52 forming a flow path opening portion 50, which allows a portion of water supplied from the throat pipe 38 toward the water conduit 16 to overflow into the reservoir tank 26. The purpose of the overflow portion 52 is to assure that in all the steps during flushing of the toilet main body 2, the flow rate of water supplied from the water conduit 16 to the bowl portion 6 does not exceed a predetermined specified flow rate F1 when the flow rate of water flowing into the throat pipe 38 exceeds the predetermined specified flow rate F1 (the defined flow rate set so that flush water does not splash (does not overflow) outside the bowl portion).

The overflow portion 52 comprises a flow path opening portion 50 formed so that flush water from the flow path can be allowed to overflow, and an opening upstream-side flow path 54 disposed below the flow path opening portion 50.

The flow path opening portion 50 of the overflow portion 52 is formed between the downstream end 38*d* of the throat pipe 38 and the tank inside shelf surface (tank inside surface) 26*c*. Stated differently, the downstream end 38*d* of the throat pipe 38 is disposed on the inside of the circular discharge port 14 formed on the tank inside shelf surface 26*c*, and the opening portion on the inside part of the discharge port 14 and the outside part of the throat pipe 38 forms the flow path opening portion 50. In the present embodiment, the downstream end 38*d* of the throat pipe 38 is disposed at the same height as the tank inside shelf surface 26*c*. The flow path opening portion 50 is formed to open upward on the tank inside shelf surface 26*c*. Note that the downstream end 38*d* of the throat pipe 38 may also extend to the lower side of the tank inside shelf surface 26*c* (interior of the discharge port 14).

The tank inside shelf surface 26*c* is a part of the center region between the left and right lower tank projecting portions 26*b*, and is formed in essentially a horizontal plane. The height position of the full water level WL0 inside the reservoir tank 26 is set to be close to the height position of the tank inside shelf surface 26*c*. In addition, the reservoir tank 26 is formed so that the height position of the full water level WL0 inside the reservoir tank 26 is below the height position of the tank inside shelf surface 26*c*.

The flow path opening portion 50 of the overflow portion 52 is formed at a height position which is normally at or above the full water level WL0 height position. The flow path opening portion 50 can therefore also be used as an overflow opening. When the water level of flush water inside the reservoir tank 26 rises above the full water level WL0 for some reason, the flush water is discharged to the toilet main body 2 from the flow path opening portion 50.

In the present embodiment, the opening upstream-side flow path 54 of the overflow portion 52 also serves as the water conduit 16 of toilet main body 2. The opening upstream-side flow path 54 may also be a connecting flow path member connected to the water conduit 16 of the toilet main body 2. The opening upstream-side flow path 54 may be integrally formed with the water conduit 16, or may be formed by the water conduit 16 and a separate member.

Figure 7:
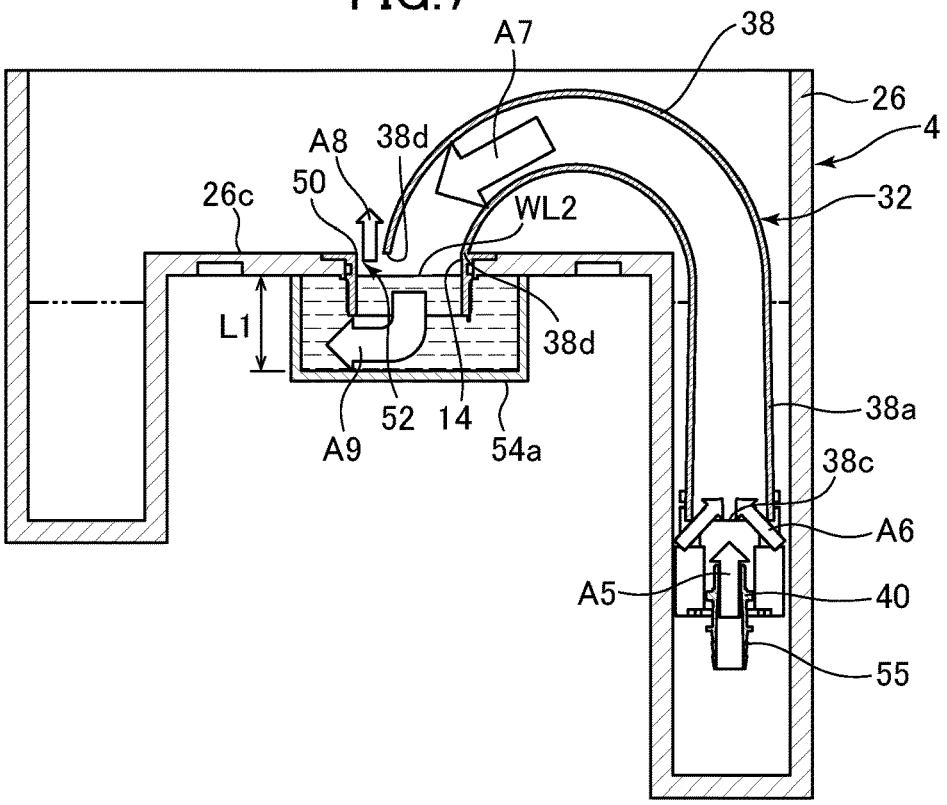
FIG. 7 is a diagram showing the appearance of flush water flowing in the throat pipe, the flow path opening portion, and the opening upstream-side flow path when the flow rate of water in the throat pipe exceeds a predetermined flow rate F1.

Here, as shown in FIG. 7, the opening upstream-side flow path 54 is formed so that the distance L1 (height) between the upstream-side flow path bottom surface 54*a* thereof and the flow path opening portion 50 is a relatively short length (a relatively low height). The distance L1 is formed at a length (height) such that when the flow rate of flush water in the throat pipe 38 exceeds a specified flow rate F1, flush water flowing in from the throat pipe 38 to the opening upstream-side flow path 54 and colliding with the upstream-side flow path bottom surface 54*a* can overflow from the flow path opening portion 50.

The opening downstream-side flow path 54 constitutes a flow path extending in the front-to-back direction of the toilet main body 2 on the lower side of the flow path opening portion 50. The opening upstream-side flow path 54 is a portion of the water conduit 16, and that flow path of the water conduit 16 is branched on the downstream side as described above, and is somewhat narrow. Therefore when flush water flowing into the opening upstream-side flow path 54 of the overflow portion 52 reaches a flow rate exceeding the predetermined specified flow rate F1, that flush water is subjected to a pressure loss in the narrowed flow path. As a result of that pressure loss, the upstream side of the water conduit 16, which is to say the opening upstream-side flow path 54, becomes full of water, and flush water overflows from the flow path opening portion 50 into the reservoir tank 26. Also, the state whereby the opening upstream-side flow path 54 fills with water includes, in addition to the state in which the entire opening upstream-side flow path 54 is filled with water, the state in which a portion of the flow path on the flow path opening portion 50 side of the opening upstream-side flow path 54 is full, and the state in which the area close to the flow path opening portion 50 of the opening upstream-side flow path 54 is filled with flush water.

Referring to FIGS. 4, 6, and 7, the operation during a large flush of a flush toilet apparatus 1 according to the present embodiment is explained.

First, FIG. 4 shows a flush water tank apparatus 4 prior to start of a large flush. In the state, the water level inside the reservoir tank 26 is at the normal full water level WL0; the main valve body 48 of the water supply valve apparatus 30 seats on the main valve seat (not shown) and water is shut off.

When a large flush is started, operation of the manual lever 34 in one direction by a user results in rotation of the drive shaft 36 to which the manual lever 34 is connected. Rotation of the drive shaft 36 causes the pilot valve of the water supply valve apparatus 30 to reach an open state, such that the main valve body 48 of the water supply valve apparatus 30 separates from the main valve seat and enters a water supply state in which water is supplied. When the flush water drops, the water supply float 60 drops and the main valve body 48 is released, so that the water supply valve apparatus 30 maintains an open state.

As shown in FIGS. 3 and 6, flush water supplied from an external water supply source passes through a shutoff faucet (not shown), through the constant flow rate valve 42 and the water supply valve apparatus 30, and reaches the jet nozzle 40 at the downstream end of the jet flow path 55. As shown by arrow A1 in FIG. 6, flush water is jetted from the jet nozzle 40 toward the suction port 38*c* on the throat pipe 38. The area close to the suction port 38*c* of the throat pipe 38 experiences a negative pressure, so flush water stored in the reservoir tank 26 is also suctioned into the throat pipe 38, as shown by arrow A2. Therefore the volume of flush water flowing in the throat pipe 38, shown by arrow A3, is increased more than the volume of flush water jetted out from the jet nozzle 40 (arrow A1), and the increased volume of flush water is supplied from the downstream end 38*d* to the toilet main body 2 water conduit 16.

FIG. 6 shows the flow rate of flush water when the flow rate of flush water in the throat pipe 38 does not reach the predetermined specified flow rate F1. In the case, as shown by arrow A4, flush water flowing downward from the downstream end 38*d* toward the discharge port 14 and the opening upstream-side flow path 54 flows smoothly from the opening upstream-side flow path 54 to the downstream side. At the point, the water level inside the opening upstream-side flow path 54 is at WL1, as shown in FIG. 6, and flows toward the water conduit 16, not overflowing from the path opening portion 50.

On the other hand, FIG. 7 shows the flow of flush water when the flow rate of flush water in the throat pipe 38 does exceed the predetermined specified flow rate F1. In the case, the relatively high flow rate of flush water jetted from the jet nozzle 40, as shown by arrow A5, is combined with the relatively high flow rate of flush water stored in the reservoir tank 26 and suctioned into the throat pipe 38, as shown by arrow A6. In the manner the flow rate of water flowing in the throat pipe 38 increases more, and exceeds the predetermined specified flow rate F1.

Moreover, as shown by arrow A7, flush water which flows downward from the downstream end 38*d* of the throat pipe 38 toward the discharge port 14 and the opening upstream-side flow path 54 has a relatively high instantaneous flow rate, therefore when subjected to pressure loss in the opening upstream-side flow path 54 and the water conduit 16 it fills up the opening upstream-side flow path 54, unable to flow out on to the downstream side from the opening upstream-side flow path 54. The water level inside the opening upstream-side flow path 54 is essentially at the full water level WL2, and as shown by arrow A8, overflows from the flow path opening portion 50 of the overflow portion 52 into the reservoir tank 26. I.e., the opening upstream-side flow path 54 becomes full and flush water pressure increases, causing the flush water to overflow. Therefore the flow rate of flush water supplied to the toilet main body 2, as shown by arrow A9, is decreased by just the flow rate of water which overflowed from the flow path opening portion 50.

Continuing, when jetting of flush water from the jet nozzle 40 into the throat pipe 38 is continued and flush water inside the reservoir tank 26 is suctioned into the throat pipe 38, the volume of flush water inside the reservoir tank 26 decreases. When the flush water volume decreases, the float 60 drops, triggering the switching means, and the supply of flush water jetted from the jet nozzle 40 is switched from the throat pipe 38 into the makeup water flow path 56 and the reservoir tank 26. Hence flush water is supplied into the reservoir tank 26, and flush water passes through the makeup water flow path 56 and is supplied as makeup water from the water conduit 16 to the toilet main body 2.

When the water level of flush water inside the reservoir tank 26 rises, the water supply float 60 rises, the main valve body is closed, and the water supply valve apparatus 30 is placed in a shutoff state. At the point the supply of water from the jet nozzle 40 ends, the supply of flush water to the makeup water flow path 56 also ends, and the large flush is completed.

Figure 5:
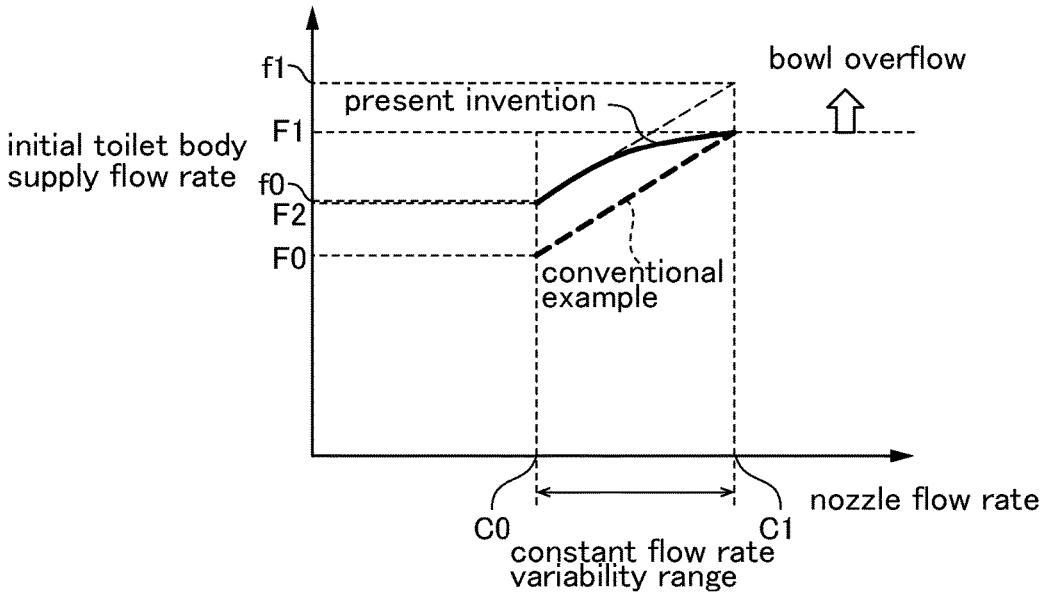
FIG. 5 is a diagram explaining the relationship between the supply flow rate of flush water to the toilet main body at start of flush and the variability in flush water volume jet from a jet nozzle, in a flush toilet apparatus according to a first embodiment of the present invention.

Next, using FIGS. 5 through 7, the relationship between the supply flow rate of flush water to a toilet main body and variability in the flow rate of flush water jetted from the jet nozzle 40, in a flush toilet apparatus 1 according to the present embodiment.

As described above, when conditions such as utility water pressure and supply pressure, etc. vary at sites (construction sites where the flush toilet apparatus 1 is being installed), variability in the flow rate (instantaneous flow rate) of water passing through the constant flow rate valve 42 can also occur. When variability occurs in the flow rate of water passing through the constant flow rate valve 42, variability in the flow rate of water jetted from the jet nozzle 40 also occurs.

First, as a comparison with the operation and effect of the present embodiment, a conventional example is explained.

As shown in FIG. 5, in a conventional flush toilet apparatus, for example, if variability in the flow rate of water jetted from the jet nozzle 40 is assumed to be in a range of C0-C1, the supply flow rate of flush water to the toilet main body at the start of flush (in the case, the flow rate of water flowing through the interior of the throat pipe 38), which is proportional to the flow rate of water jetted from the jet nozzle 40, varies over a range F0-F1.

Conventionally, at such times when the flow rate of water sprayed from the jet nozzle 40 reached the maximum C1 flow rate, flush water was prevented from splashing out from the bowl portion 6 by assuring that the supply flow rate of flush water to the toilet main body 2 (flow rate of water flowing inside the throat pipe 38) did not exceed the above-described predetermined specified flow rate F1. However when the supply flow rate of flush water to the toilet main body 2 is in the way prevented from exceeding the predetermined specified flow rate F1, the supply flow rate of flush water to the toilet main body 2 becomes a flow rate F0 when the flow rate of water jetted from the jet nozzle 40 reaches the minimum C0 value. Hence the supply flow rate of flush water to the toilet main body 2 decreases, and the flushing performance in the bowl portion 6 declines.

In the case, as shown in FIG. 6, flush water flowing down from the downstream end 38*d* of the throat pipe 38 toward the discharge port 14 and the opening upstream-side flow path 54 flows from the opening upstream-side flow path 54 toward the water conduit 16, without overflowing from the flow path opening portion 50.

In contrast, in the flush toilet apparatus of the above-described present embodiment, if it is assumed the flow rate of water jetted from the jet nozzle 40 varies over a range of C0-C1, then the supply flow rate of flush water to the toilet main body at the start of flushing, which corresponds to the flow rate of water jetted from the jet nozzle 40, can be made to vary over a range of F2-F1.

At the time, in the present embodiment, the supply flow rate of flush water to the toilet main body and the flow rate of water in the throat pipe 38 are different. I.e., in the present embodiment, when the flow rate of water jetted from the jet nozzle 40 varies in a range of C0-C1, the flow rate of water in the throat pipe 38, which is proportional to the flow rate of water jetted from the jet nozzle 40, is made to vary over a range f0-f1.

Therefore in the present embodiment, at C1 where the flow rate of water jetted from the jet nozzle 40 is at a maximum, the flow rate of water in the throat pipe 38 becomes f1. The flow rate f1 is a higher value than the predetermined specified flow rate F1, and the supply flow rate of flush water to the toilet main body 2 is assumed to exceed the predetermined specified flow rate F1.

In the case, as explained with reference to FIG. 7, flush water flowing from the downstream end 38*d* of the throat pipe 38 toward the opening upstream-side flow path 54 fills the opening upstream-side flow path 54 when subjected to pressure loss in the opening upstream-side flow path 54 and/or the water conduit 16. The results in the flush water overflowing from the flow path opening portion 50 into the reservoir tank 26. Therefore the supply flow rate of flush water into the toilet main body 2 is reduced by just the amount of overflowed water.

At CO, on the other hand, where the flow rate of water jetted from the jet nozzle 40 is at a minimum, the supply flow rate of flush water to the toilet main body 2 becomes a flow rate F2 (the flow rate of water flowing through the interior of the throat pipe 38 is f0), which is a lower value than the predetermined specified flow rate F1. At the point, as explained above using FIG. 6, the flush water flowing downward from the downstream end 38*d* toward the opening upstream-side flow path 54 flows from the opening upstream-side flow path 54 toward the water conduit 16, not overflowing from the flow path opening portion 50.

At C1, as described above, when the flow rate of water jetted from the jet nozzle 40 is at a maximum, the supply flow rate of flush water to the toilet main body 2 can be prevented from exceeding the predetermined specified flow rate F1, therefore at flow rate C0, when the flow rate of water jetted from the jet nozzle 40 is at a minimum, the supply flow rate of flush water to the toilet main body 2 can be made relatively large, so that the supply flow rate of flush water to the toilet main body 2 becomes flow rate F2. Specifically, the flow rate of flush water to the toilet main body 2 relative to the flow rate of water jetted from the jet nozzle 40 can be increased by the design of the diameter of the jet nozzle 40 and/or the shape of the throat pipe 38, etc.

Therefore even at CO, where the flow rate of water jetted from the jet nozzle 40 is at a minimum, the supply flow rate of flush water to the toilet main body 2 can be increased to approach the predetermined specified flow rate F1. As a result, bowl portion 6 flushing performance can be improved.

On the other hand, even if the supply flow rate of flush water to the toilet main body 2 is increased in the manner, the present embodiment provides an overflow portion 52 flow path opening portion 50, therefore even at C1, where the flow rate of water is at a maximum, the supply flow rate of flush water to the toilet main body 2 can be prevented from exceeding the predetermined specified flow rate F1.

Hence even in cases where the flow rate of water jetted from the jet nozzle 40 varies, a flow rate relatively close to the predetermined specified flow rate F1 can be achieved while assuring, by the overflow portion 52, that the supply flow rate of flush water to the toilet main body 2 does not exceed the predetermined specified flow rate F1. As a result, bowl portion 6 flushing performance can be maintained at a relatively high flushing performance.

As explained above, even when the flow rate of water jetted from the jet nozzle 40 varies, the supply flow rate of flush water to the toilet main body at start of flush can, using the overflow portion 52, be made to vary in a range F2-F1, which is narrower than the conventional flush water supply flow rate range of F0-F1.

As explained above, a flush toilet apparatus 1 according to a first embodiment of the present invention comprises an overflow portion 52 with a flow path opening portion 50 which, when the flow rate of water in a throat pipe 38 exceeds a predetermined specified flow rate F1, causes a portion of water supplied from the throat pipe 38 toward the water conduit 16 to overflow into the reservoir tank 26. By so doing, when a predetermined flow rate of water supplied from the constant flow rate valve 42 to the jet nozzle 40 varies due to conditions such as utility water pressure at the site, the flow rate of water supplied from the water conduit 16 to the bowl portion 6 can be reduced to less than the predetermined specified flow rate F1 in any of the steps during flushing of the toilet main body 2. Since the increase in water flow rate caused by variability in the flow rate of water supplied to the jet nozzle 40 from the constant flow rate valve 42 can thus be absorbed, splashing or overflowing from the bowl portion 6 can be prevented. In addition, when the flow rate of water supplied to the jet nozzle 40 varies and decreases in any of the steps during flushing of the toilet main body 2, a relatively large flow rate value close to the predetermined specified flow rate F1 can be given to the flow rate of water supplied from the constant flow rate valve 42 to the jet nozzle 40, and the decrease in flushing performance can be limited.

Also, in the present embodiment, the flow path opening portion 50 of the overflow portion 52 is formed at a height position at or above the full water level WL0 when the inside of the reservoir tank 26 is full. Here, if the flow path opening portion 50 of the overflow portion 52 is hypothetically formed below the full water level WL0 when the interior of reservoir tank 26 is full, then flush water flowing in the throat pipe 38 will cease to flow out into the reservoir tank 26, or the outflow amount will be insufficient. There is a risk that due to such causes the flow rate of water supplied to the bowl portion 6 cannot be reduced to less than the predetermined specified flow rate F1, and flush water may splash outside from the bowl portion 6. With the embodiment, such risks can be prevented.

Moreover, using the present embodiment, when the flow rate of water supplied to the jet nozzle 40 declines due to variability, flush water can be supplied to the water conduit 16 using the overflow portion 52, without causing flush water to overflow into the reservoir tank 26. Therefore the decline in flush performance caused by variability in the flow rate of water supplied from the constant flow rate valve 42 to the jet nozzle 40 can be more reliably constrained.

In addition, using the present embodiment, the flow path opening portion 50 is formed at a height position close to the water level when the inside of the reservoir tank 26 is full. Hence compared to the case when the flow path opening portion 50 is formed on the upper side of the throat pipe 38, the flow rate of water supplied to the bowl portion 6 by the overflow portion 52 can be reduced at an earlier stage by more than the predetermined specified flow rate.

Also, using the present embodiment, the discharge port 14 is formed on the flow path between the throat pipe 38 and the water conduit 16, and is disposed at a height position close to the water level when the inside of the reservoir tank 26 is full. Also, the flow path opening portion 50 is formed between the throat pipe 38 and the discharge port 14. Hence compared to the case when the flow path opening portion 50 of the overflow portion 52 is formed on the upper side of the throat pipe 38, the flow rate of water supplied to the bowl portion 6 by the overflow portion 52 can be reduced at an earlier stage by more than the predetermined specified flow rate.

Figure 8:
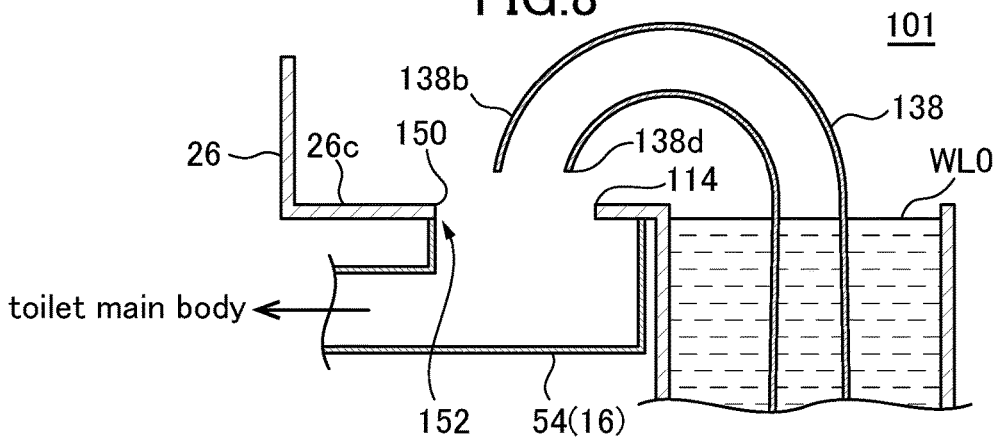
FIG. 8 is a cross section showing an overview of a throat pipe, a reservoir tank, an opening upstream-side flow path, and an overflow portion according to a second embodiment of the present invention.

Next, using FIG. 8, a flush toilet apparatus 101 according to a second embodiment of the present invention is explained. The second embodiment is an example in which the flow path opening portion 50 of the overflow portion 52 in the flush toilet apparatus 1 according to the above-described first embodiment is formed with a different structure.

Since the flush toilet apparatus according to the second embodiment has essentially the same structure as the flush toilet apparatus according to the first embodiment, the same reference numerals are assigned and an explanation thereof is omitted, explaining here only the parts which differ between the first embodiment and the second embodiment. Note that the explanation of the third through seventh embodiments given below with reference to FIGS. 8 through 13 is also the same.

In FIG. 8, explanations of structures other than the flow path opening portion on the flush toilet apparatus overflow portion are omitted. Below, FIGS. 9 through 13 are similarly shown.

As shown in FIG. 8, in a flush toilet apparatus 101 according to a second embodiment, the downstream end 138*d* of the descending pipe portion 138*b* on throat pipe 138 is disposed at a separated position, above the tank inside shelf surface 26*c*.

The flush toilet apparatus 101 comprises an overflow portion 152 having a flow path opening portion 150. In each of the steps during the flushing of the toilet main body 2, the overflow portion 152 causes a portion of water supplied from the throat pipe 138 toward the water conduit 16 to overflow into the reservoir tank 26 when the flow rate of water inside the throat pipe 138 exceeds the predetermined specified flow rate F1 described above in the first embodiment. The flow rate of water supplied from the water conduit 16 to the bowl portion 6 can in the way be reduced to less than the predetermined specified flow rate F1.

The overflow portion 152 comprises a flow path opening portion 150 formed so that flush water from the flow path can be allowed to overflow, and an opening upstream-side flow path 54 disposed below the flow path opening portion 150.

The flow path opening portion 150 is formed between the downstream end 138*d* of the throat pipe 138 disposed above the discharge port 114 and the tank inside shelf surface 26*c* discharge port 14. I.e., the flow path opening portion 150 is disposed below the throat pipe 138 downstream end 138*d*, and at the same height position as the tank inside shelf surface 26*c* is formed by the discharge port 114. Also, at a position above the tank inside shelf surface 26*c*, the flow path opening portion 150 is formed by the gap between the discharge port 114 and the downstream end 138*d*. Therefore the flow path opening portion 150 is formed at a height position at or above the tank inside shelf surface 26*c*, and at a height position higher than the height position of the full water level WL0 when the inside of the reservoir tank 26 is full.

In the second embodiment thus constituted, when the flow rate of water supplied to the jet nozzle 40 increases due to variability, the water in the throat pipe 138 exceeds the predetermined specified flow rate F1, and as a result the flow path on the downstream side of the discharge port 114 fills with water, such that the flow rate of water supplied to the bowl portion 6 can, by the overflow portion 152, be reduced to less than the predetermined specified flow rate F1. I.e., compared to the case when a flow path opening portion 150 is formed on the upstream side of the throat pipe 138, overflowing of flush water from the bowl portion 6 can be more reliably prevented at an earlier stage.

Figure 9:
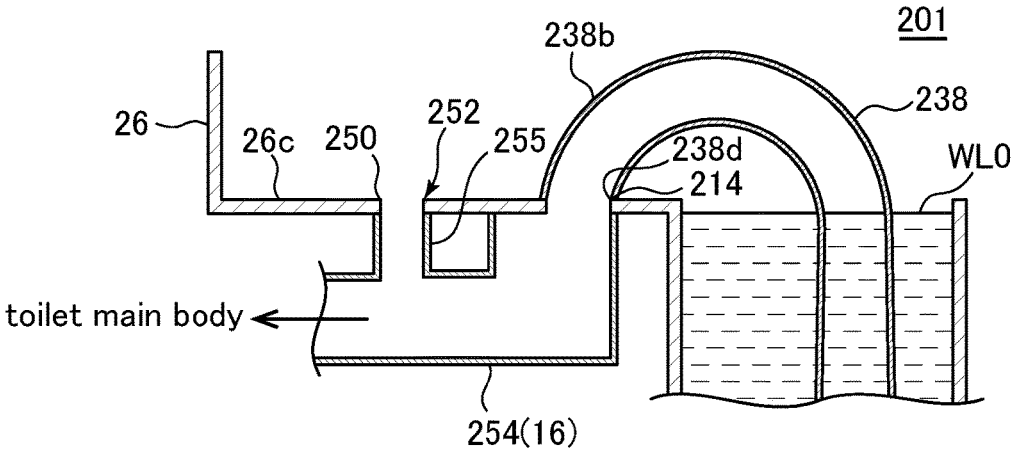
FIG. 9 is a partial cross section showing an overview of a throat pipe, a reservoir tank, an opening upstream-side flow path, and overflow portion according to a third embodiment of the present invention.

Next, using FIG. 9, a flush toilet apparatus 201 according to a third embodiment of the present invention is explained. The third embodiment is an example in which the flow path opening portion 50 of the overflow portion 52 in the flush toilet apparatus 1 according to the first embodiment of the present invention is formed by a different structure.

As shown in FIG. 9, in a flush toilet apparatus 201 according to a third embodiment, the downstream end 238*d* of the descending pipe portion 238*b* on the throat pipe 238 is attached to a discharge port 214 on the tank inside shelf surface 26*c*. Also, a flow path opening portion 250, independent of the discharge port 214, is disposed on the tank inside shelf surface 26*c*, and the flow path opening portion 250 communicates with the discharge port downstream-side flow path 254. The discharge port 214 forms a continuous pipework-shaped flow path connected to the downstream end 238*d* on the throat pipe 238. Note that the throat pipe 238 may also extend out to the lower side of the tank inside shelf surface 26*c* (interior of the discharge port 214) so that the downstream end 238*d* is positioned inside the discharge port 214.

The flush toilet apparatus 201 comprises an overflow portion 252 having a flow path opening portion 250. In each of the steps during flushing of the toilet main body 2, the overflow portion 152 causes a portion of water supplied from the throat pipe 238 toward the water conduit 16 to overflow inside the reservoir tank 26 when the flow rate of water inside the throat pipe 238 exceeds the predetermined specified flow rate F1, thereby reducing the flow rate of water supplied from the water conduit 16 to the bowl portion 6 to less than the predetermined specified flow rate F1.

The overflow portion 252 comprises a flow path opening portion 250 formed so that flush water can be caused to overflow from the discharge port downstream-side flow path 254, and an opening upstream-side flow path 255 disposed below the discharge port 214 and the flow path opening portion 250.

The flow path opening portion 250 is formed as a separate body at a position separated from the downstream end 238*d* of the throat pipe 238 connected to the discharge port 214, or at a position close to same, or at an adjacent position.

The flow path opening portion 250 is also separately formed at a position separated from the tank inside shelf surface 26*c* discharge port 214, or at a position close to same, or at an adjacent position. The flow path opening portion 250 is formed as a different flow path from the discharge port 214, and extends downward and is connected to the discharge port downstream-side flow path 254. Note that the flow path opening portion 250 may also be disposed at a position adjacent to the discharge port 214; in that case the wall surface forming the discharge port downstream-side flow path 254 close to the discharge port 214, and the wall surface forming the discharge port upstream-side flow path 255, may also be connected or formed as a single shared wall.

The flow path opening portion 250 is formed in line with the discharge port 214 on the same surface as the tank inside shelf surface 26*c*, and both are formed at the same height positions. The discharge port upstream-side flow path 255 communicates with the discharge port downstream-side flow path 254 on the upstream side of the discharge port 214. Therefore when the opening upstream-side flow path 255 fills with flush water and water pressure rises, flush water overflows into the reservoir tank 26 from the flow path opening portion 250. Additionally, although not discussed here in detail, the flow path opening portion 250 can also be used as an overflow opening. The flow path opening portion 250 is formed at the height position on the same surface as the tank inside shelf surface 26*c*, and at a height position higher than the height position of the full water level WL0 when the inside of the reservoir tank 26 is full.

In the third embodiment thus constituted, the overflow portion 252 flow path opening portion 250 is formed at a position separated from the discharge port 214 position, or at a nearby position, or at an adjacent position. Therefore when the flow rate of water in the throat pipe 38 exceeds the predetermined specified flow rate F1 and the flow path on the downstream side of the discharge port 14 is full, the flow rate of water supplied to the bowl portion 6 can, by the overflow portion 52, be reliably reduced to less than the predetermined specified flow rate F1. In other words, compared to the case when the flow path opening portion 250 is formed on the discharge port 214, overflowing of flush water from the bowl portion 6 can be more reliably prevented at an earlier stage.

Figure 10:
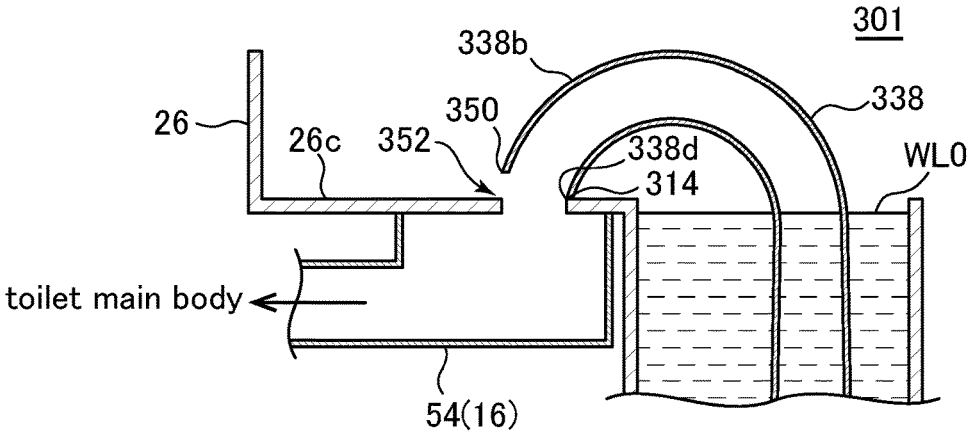
FIG. 10 is a partial cross section showing an overview of a throat pipe, a reservoir tank, an opening upstream-side flow path, and an overflow portion according to a fourth embodiment of the present invention.

Next, using FIG. 10, a flush toilet apparatus 301 according to a fourth embodiment of the present invention is explained. The fourth embodiment is an example in which the flow path opening portion 50 of the overflow portion 52 in the flush toilet apparatus 1 according to the first embodiment of the present invention is formed by a different structure.

As shown in FIG. 10, in a flush toilet apparatus 301 according to a fourth embodiment, a flow path opening portion 350 is formed at a position close to the downstream end 338*d* of the throat pipe 338.

The flush toilet apparatus 301 comprises an overflow portion 352 having a flow path opening portion 350. In each of the steps during the flushing of the toilet main body 2, the overflow portion 352 causes a portion of water supplied from the throat pipe 338 toward the water conduit 16 to overflow into the reservoir tank 26 when the flow rate of water inside the throat pipe 338 exceeds the predetermined specified flow rate F1. The flow rate of water supplied from the water conduit 16 to the bowl portion 6 can in the way be reduced to less than the predetermined specified flow rate F1.

The overflow portion 352 comprises a flow path opening portion 350 formed so that flush water from the flow path inside the throat pipe 338 can be allowed to overflow, and an opening upstream-side flow path 54 disposed below the flow path opening portion 350.

The flow path opening portion 350 is formed on at least the outer circumference of the throat pipe 338 close to the downstream end 338*d* of the throat pipe 338 disposed above the discharge port 314. Note that the flow path opening portion 350 may also be formed to straddle the outside circumference of the throat pipe 338 and the tank inside shelf surface 26*c*.

The throat pipe 338 downstream end 338*d* is attached to the discharge port 314 on the tank inside shelf surface 26*c*. At the time, the bottom end portion of the opening on the flow path opening portion 350 is positioned at essentially the same height as the top surface of the tank inside shelf surface 26*c*. The flow path opening portion 50 is formed to open to the side on the tank inside shelf surface 26*c*. The flow path opening portion 350 is formed at a height position at or above the tank inside shelf surface 26*c*, and at a height position at or above the height position of the full water level WL0 when the inside of the reservoir tank 26 is full.

In the fourth embodiment thus constituted, a least a portion of the overflow portion 352 flow path opening portion 350 is formed on the throat pipe 338, therefore the flow path opening portion 50 can be formed in a relatively simple manner by the throat pipe 338. Therefore when the flow rate of water in the throat pipe 338 exceeds the predetermined specified flow rate F1, the flow rate of water supplied to the bowl portion 6, using the overflow portion 352, can be reduced to less than the predetermined specified flow rate F1.

Figure 11:
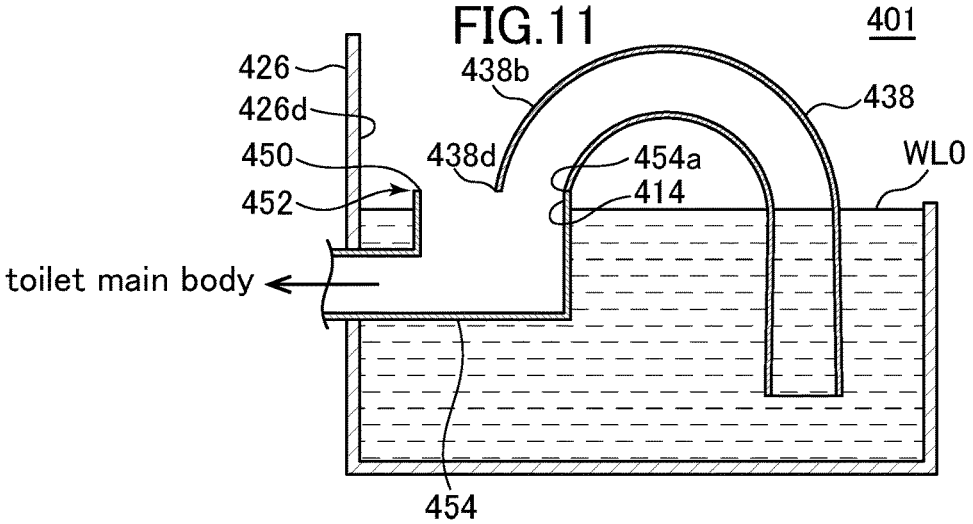
FIG. 11 is a partial cross section showing an overview of a throat pipe, a reservoir tank, an opening upstream-side flow path, and overflow portion according to a fifth embodiment of the present invention.

Next, using FIG. 11, a flush toilet apparatus 401 according to a fifth embodiment of the present invention is explained. The fifth embodiment is an example in which the opening upstream-side flow path 54 of the overflow portion 52 and reservoir tank 26 according to a first embodiment of the present invention are formed by a different structure.

As shown in FIG. 11, in the flush toilet apparatus 401 according to the fifth embodiment, an opening upstream-side flow path 454 is disposed inside the reservoir tank 426, and an independent flow path is formed inside that reservoir tank 426. The opening upstream-side flow path 454 penetrates the tank side surface (tank inside surface) 426*d* in the reservoir tank 426 at the downstream side thereof, and is connected to the water conduit of the toilet main body 2. The opening upstream-side flow path 454 is connected at the upstream side thereof to the downstream end 438*d* of the descending pipe portion 38*b* of the throat pipe 438.

The flush toilet apparatus 401 comprises an overflow portion 452 having a flow path opening portion 450. The overflow portion 452 comprises a flow path opening portion 450 and an opening downstream-side flow path 454, placed below the flow path opening portion 450.

In each of the steps during the flushing of the toilet main body 2, the overflow portion 452 causes a portion of flush water supplied from the throat pipe 438 toward the water conduit 16 to overflow into the reservoir tank 426 when the flow rate of water inside the throat pipe 438 exceeds the predetermined specified flow rate F1. The flow rate of water supplied from the water conduit 16 to the bowl portion 6 can in the way be reduced to less than the predetermined specified flow rate F1.

In the present embodiment, the opening upstream-side flow path 454 extends in the inward direction, penetrating the tank side surface 426*d* on the reservoir tank 426. The overflow portion 452 is formed on the opening upstream-side flow path 454. In the present embodiment, the opening upstream-side flow path 454 forms the discharge port 414. The opening upstream-side flow path 454 winds laterally under the flow path opening portion 450, and its height from peak surface 454*a* to the bottom surface is relatively low. Flush water flowing in from above is thus relatively likely to overflow.

The flow path opening portion 450 is formed between the downstream end 438*d* of the throat pipe 438 and the peak surface 454*a* on the opening upstream-side flow path 454. Stated differently, the downstream end 438 on the throat pipe 438 is disposed on the inside of the round discharge port 414 formed on the peak surface 454*a* of the opening upstream-side flow path 454, and the opening portion in the part inside the discharge port 414 and outside the throat pipe 438 forms the flow path opening portion 450. In the present embodiment the downstream end 138*d* of the throat pipe 438 is disposed at the height of the peak surface 454*a* on the opening upstream-side flow path 454. The flow path opening portion 450 is formed to open upward. Also, the downstream end 438*d* of the throat pipe 438 may extend to the interior of the discharge port 414.

Close to the center on the inside of the reservoir tank 426, the peak surface 454*a* of the opening upstream-side flow path 454 is formed at a height position close to the height position of the full water level WL0 when the inside of the reservoir tank 426 is full. The peak surface 454*a* may also be formed at a height position at or above the height position of the full water level WL0 when the inside of the reservoir tank 426 is full. The flow path opening portion 450 on the overflow portion 452 is also used as an overflow opening.

In the fifth embodiment thus constituted, the flow path opening portion 450 is formed between the downstream end 38*d* of the throat pipe 38 and the discharge port 414 formed on the peak surface 454*a* of the opening upstream-side flow path 454, and the discharge port 414 of the upstream-side flow path 454 is disposed at a height position close to the height position of the full water level WL0 when the inside of the reservoir tank 426 is full. Therefore when the flow rate of water flowing inside the throat pipe 438 exceeds the predetermined specified flow rate F1 and the flow path on the downstream side of the discharge port 14 is full, the flow rate of water supplied to the bowl portion 6 can, by the overflow portion 452, be reduced to less than the predetermined specified flow rate F1. I.e., compared to the case when the overflow portion 452 flow path opening portion 450 is formed on the upstream side of the throat pipe 438, overflowing of flush water from the bowl portion 6 can be more reliably prevented at an earlier stage.

Figure 12:
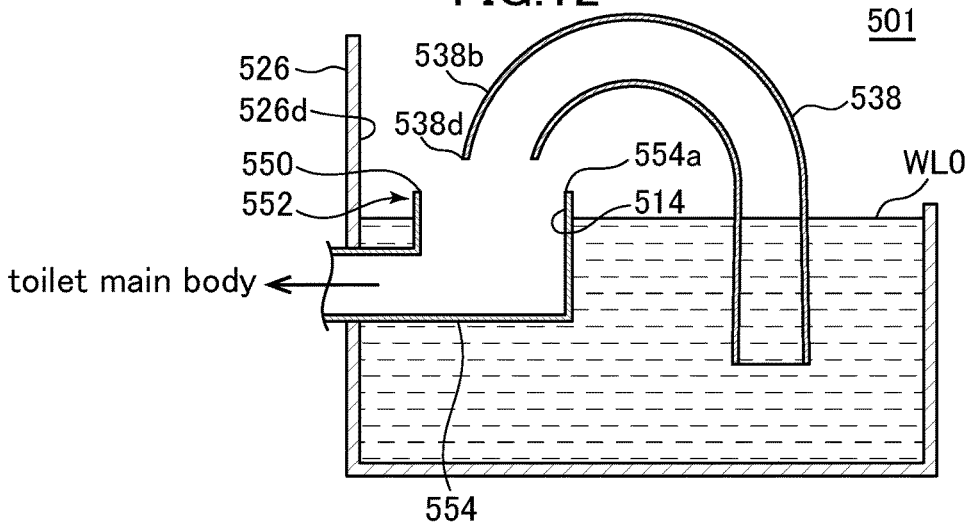
FIG. 12 is a partial cross section showing an overview of a throat pipe, a reservoir tank, an opening downstream-side flow path, and an overflow portion according to a sixth embodiment of the present invention.

Next, using FIG. 12, a flush toilet apparatus 501 according to a sixth embodiment of the present invention is explained. The sixth embodiment is an example in which the opening upstream-side flow path 54 of the overflow portion 52 and the reservoir tank 26 of the first embodiment of the present invention are formed by a different structure.

As shown in FIG. 12, in a flush toilet apparatus 501 according to a sixth embodiment, an opening upstream-side flow path 554 is disposed on the inside of the reservoir tank 526, and an independent flow path is formed on the inside of the reservoir tank 526.

The downstream-side part of the opening upstream-side flow path 554 penetrates the tank side surface (tank inside surface) 526*d* of the reservoir tank 526 and is connected to the toilet main body 2 water conduit. The opening upstream-side flow path 554 is placed so that its upstream-side part is separated from the downstream end 538*d* of the throat pipe 538. The downstream end 538*d* of the throat pipe 538 is disposed above the peak surface 554*a* of the opening upstream-side flow path 554. The opening upstream-side flow path 554 winds laterally under the flow path opening portion 550, and its height from peak surface 554*a* to bottom surface is relatively low. Flush water flowing in from above is thus relatively likely to overflow.

The flush toilet apparatus 501 comprises an overflow portion 552 having a flow path opening portion 550. In each of the steps during the flushing of the toilet main body 2, the overflow portion 550 causes a portion of water supplied from the throat pipe 538 toward the water conduit 16 to overflow into the reservoir tank 526 when the flow rate of water inside the throat pipe 538 exceeds the predetermined specified flow rate F1. The flow rate of water supplied from the water conduit 16 to the bowl portion 6 can in the way be reduced to less than the predetermined specified flow rate F1.

The opening upstream-side flow path 554 penetrates the tank side surface 526*d* of the reservoir tank 526 and extends inward. The overflow portion 552 is formed on the opening upstream-side flow path 554. The overflow portion 552 comprises a flow path opening portion 550 and the opening upstream-side flow path 554, placed below the flow path opening portion 550. In the present embodiment, the opening upstream-side flow path 554 forms the discharge port 514.

The flow path opening portion 550 is formed between the throat pipe 538 downstream end 538*d* and the discharge port 514. The flow path opening portion 550 is placed under the throat pipe 538 downstream end 538*d*.

At the same height as the peak surface 554*a* of the opening upstream-side flow path 554, the flow path opening portion 550 is formed by the discharge port 514. Above the peak surface 554*a*, the flow path opening portion 550 is formed by the gap between the discharge port 514 and the downstream end 538*d*. The flow path opening portion 550 is formed at a height position at or above the peak surface 554*a*, and at a height position higher than the height position of the full water level WL0 when the inside of the reservoir tank 526 is full.

In the part of the center area between the left and right lower tank projection portions (see FIG. 2 etc.) of the reservoir tank 526, the peak surface 554*a* of the opening upstream-side flow path 554 is formed at a height position close to the height position of the full water level WL0 when the inside of the reservoir tank 526 is full. The peak surface 554*a* may also be formed at a height position at or above the height position of the full water level WL0 when the inside of the reservoir tank 526 is full. The flow path opening portion 550 on the overflow portion 552 is also used as an overflow opening.

In the sixth embodiment thus constituted, the flow path opening portion 550 is formed between the throat pipe 538 downstream end 538*d* and the discharge port 514 disposed at a height position close to the height position of the full water level WL0 when the inside of the reservoir tank 526 is full. Therefore compared to the case when the flow path opening portion 550 is formed on the upstream side of the throat pipe 538, the flow rate of water supplied to the bowl portion 6 by the overflow portion 552 can, at an earlier stage, be more reliably reduced to less than the predetermined specified flow rate F1.

Figure 13:
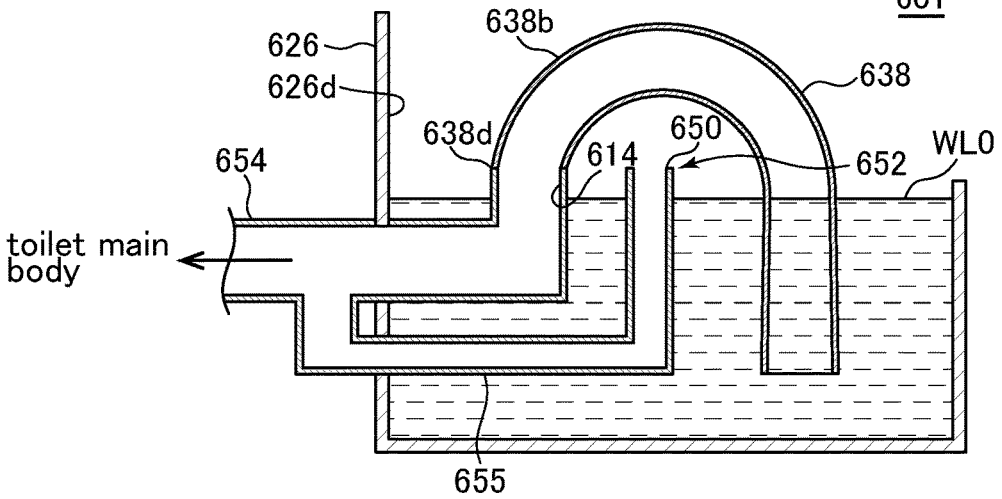
FIG. 13 is a partial cross section showing an overview of a throat pipe, a reservoir tank, an opening upstream-side flow path, and an overflow portion according to a seventh embodiment of the present invention.

Next, using FIG. 13, a flush toilet apparatus 601 according to a seventh embodiment of the present invention is explained. The seventh embodiment is an example in which the opening upstream-side flow path 54 of the overflow portion 52 and the reservoir tank 26 of the first embodiment of the present invention are formed by a different structure.

As shown in FIG. 13, in a flush toilet apparatus 501 according to a seventh embodiment a discharge port downstream-side flow path (first flow path) 654 is disposed on the inside of the reservoir tank 626, and an independent flow path is formed on the inside of the reservoir tank 626. The downstream-side part of the discharge port downstream-side flow path 654 penetrates the tank side surface (tank inside surface) 626*d* of the reservoir tank 626 and is connected to the toilet main body 2 water conduit. The upstream side part of the discharge port downstream-side flow path 654 is connected to the downstream end 638*d* of the throat pipe 638. Also, a flow path opening portion 650 is placed in a position independent and separate from the discharge port 614, and the opening upstream-side flow path 655 (second flow path) and discharge port downstream-side flow path 654 mutually communicate. Note that the flow path opening portion 650 may also be disposed at a position adjacent to the discharge port (discharge port portion) 614; in that case the wall surface forming the discharge port downstream-side flow path 654 close to the discharge port 614 and the wall surface forming the opening upstream-side flow path 655 may also be connected, or formed as a single shared wall.

The flush toilet apparatus 601 comprises an overflow portion 652 with a flow path opening portion 650. In each of the steps during the flushing of the toilet main body 2, the overflow portion 652 causes a portion of water supplied from the throat pipe 638 toward the water conduit 16 to overflow into the reservoir tank 626 when the flow rate of water inside the throat pipe 638 exceeds the predetermined specified flow rate F1. The flow rate of water supplied from the water conduit 16 to the bowl portion 6 can in the way be reduced to less than the predetermined specified flow rate F1.

The discharge port 614 forms a continuous plumbing-shaped flow path connected to the downstream end 638*d* on the throat pipe 638. The throat pipe 638 downstream end 638*d* may also extend up to the interior of the discharge port 614 on the discharge port downstream-side flow path 54.

The flow path opening portion 650 is formed at a position separated from the downstream end 638*d* of the throat pipe 638, which is connected to the discharge port 614. Note that the flow path opening portion 650 is formed as a separate body, at a position separated from the discharge port 614 on the discharge port downstream side flow path 654, or at a position close by, or at an adjacent position. The flow path opening portion 650 is formed as a separate flow path from the discharge port 614, and extends to the downstream side and is connected to the discharge port downstream-side flow path 654. The opening upstream-side flow path 655 (second flow path) is connected at the discharge port downstream-side flow path 654 (first flow path) on the outside of the reservoir tank 626, but may also be connected at the inside of the reservoir tank 626.

The flow path opening portion 650 is disposed to align at the same height position as the discharge port 614. The flow path opening portion 650 communicates on the downstream side with the discharge port downstream-side flow path 654. Therefore, when the downstream-side flow path 654 fills with flush water and water pressure rises, the flush water is caused to overflow into the reservoir tank 626 from the flow path opening portion 650. The flow path opening portion 650 is also used as an overflow opening. The flow path opening portion 650 is formed at a height position at or above the height position of the full water level WL0 when the inside of the reservoir tank 626 is full.

In the seventh embodiment thus constituted, the flow path opening portion 650 of the overflow portion 652 is formed as a separate body from the discharge port 614. Therefore when the flow rate of water in the throat pipe 638 exceeds the predetermined specified flow rate F1 and the flow path on the downstream side of the discharge port 14 is full, the flow rate of water supplied to the bowl portion 6 can, by the overflow portion 652, be reduced to less than the predetermined specified flow rate F1. I.e., compared to the case when the flow path opening portion 650 of the overflow portion 652 is formed above the throat pipe 638, overflowing of flush water from the bowl portion 6 can be more reliably prevented at an earlier stage.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet for discharging waste with flush water supplied by a jet pump action, comprising:

a toilet main body having a bowl and a water conduit for conducting the flush water to the bowl;

a reservoir tank configured to hold the flush water supplied to the water conduit;

a jet pump unit disposed inside the reservoir tank; and a valve configured to supply the flush water with a predetermined flow rate to the jet pump unit;

wherein the jet pump unit comprises:

a throat pipe having a suction port, submerged in the flush water and formed on an upstream side thereof so as to suction the flush water in the reservoir tank, and a downstream end for allowing the flush water therein to flow out; and a jet nozzle configured to jet the flush water into the throat pipe and suction the flush water in the reservoir tank into the throat pipe through the suction port of the throat pipe by the jet pump action so that the flow rate of the flush water in the throat pipe is increased more than the flow rate of the flush water jetted from the jet nozzle;

wherein the flush toilet further comprises:

a discharge port formed between the throat pipe and the water conduit, and disposed at a height at or above a full water level of the reservoir tank;

an overflow conduit configured to overflow a portion of the flush water, which is supplied from the throat pipe to the water conduit, into the reservoir tank so that when the flow rate of the flush water in the throat pipe exceeds a predetermined specified flow rate, the flow rate of the flush water supplied from the water conduit to the bowl portion is reduced to less than the predetermined specified flow rate;

wherein the overflow conduit comprises a flow path opening, whose lowest portion is disposed at a height of the discharge port.

2. The flush toilet apparatus according to claim 1, wherein the overflow conduit is configured not to allow the flush water supplied from the throat pipe to the water conduit to overflow from the flow path opening into the reservoir tank, when the flow rate of the flush water inside the throat pipe does not exceed the predetermined specified flow rate.

3. The flush toilet apparatus according to claim 1, wherein the flow path opening of the overflow conduit is formed in a part of the discharge port.

4. The flush toilet apparatus according to claim 1, wherein at least a portion of the flow path opening of the overflow conduit is formed on the throat pipe.

* * * * *